US009791176B2

(12) United States Patent
Kawano et al.

(10) Patent No.: US 9,791,176 B2
(45) Date of Patent: Oct. 17, 2017

(54) REFRIGERATION APPARATUS

(71) Applicant: DAIKIN INDUSTRIES, LTD., Osaka-shi, Osaka (JP)

(72) Inventors: Satoshi Kawano, Sakai (JP); Shinya Matsuoka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 375 days.

(21) Appl. No.: 14/402,076

(22) PCT Filed: May 8, 2013

(86) PCT No.: PCT/JP2013/062946
§ 371 (c)(1),
(2) Date: Nov. 18, 2014

(87) PCT Pub. No.: WO2013/175963
PCT Pub. Date: Nov. 28, 2013

(65) Prior Publication Data

US 2015/0128635 A1 May 14, 2015

(30) Foreign Application Priority Data

May 23, 2012 (JP) ..... 2012-117802

(51) Int. Cl.
*F25B 43/00* (2006.01)
*F25B 9/00* (2006.01)
*F25B 13/00* (2006.01)

(52) U.S. Cl.
CPC ..... *F25B 9/002* (2013.01); *F25B 13/00* (2013.01); *F25B 43/006* (2013.01); *F25B 43/00* (2013.01);
(Continued)

(58) Field of Classification Search
CPC ... F25B 43/006; F25B 2313/001; F25B 43/00
See application file for complete search history.

(56) References Cited

U.S. PATENT DOCUMENTS 5,167,128 A * 12/1992 Bottum ..... G01F 23/74 62/174
2006/0280622 A1 12/2006 Lee et al.
2010/0218550 A1* 9/2010 Yoshioka ..... F25B 43/006 62/503

FOREIGN PATENT DOCUMENTS

EP 1 321 730 A2 6/2003
JP 63-153078 U 10/1988
(Continued)

OTHER PUBLICATIONS

European Search Report of corresponding EP Application No. 13 79 4158.9 dated Mar. 3, 2016.
(Continued)

*Primary Examiner* — David Teitelbaum
(74) *Attorney, Agent, or Firm* — Global IP Counselors, LLP

(57) ABSTRACT

A refrigeration apparatus uses R32 as a refrigerant, and includes a compressor, a condenser, an expansion mechanism, an evaporator and an accumulator. The accumulator is disposed in the suction flow path supplying refrigerant to the compressor. The accumulator has a casing that forms an inside space to separate the refrigerant into gas refrigerant and liquid refrigerant and accumulating surplus refrigerant, an inlet pipe feeding the refrigerant that has evaporated in the evaporator into the inside space, and an outlet pipe channeling the separated gas refrigerant to the compressor. A distal end opening in the inlet pipe of the accumulator is located in a height position separated by a dimension from a bottom of the inside space. The dimension is 0 to 0.3 times a height dimension of the inside space.

4 Claims, 4 Drawing Sheets

(52) U.S. Cl.
CPC ... *F25B 2313/001* (2013.01); *F25B 2313/005* (2013.01); *F25B 2313/006* (2013.01); *F25B 2313/0233* (2013.01); *F25B 2400/13* (2013.01)

(56) References Cited

FOREIGN PATENT DOCUMENTS

| | | | |
|---|---|---|---|
| JP | 6-4556 | U | 1/1994 |
| JP | 6-74613 | A | 3/1994 |
| JP | 8-178476 | A | 7/1996 |
| JP | 2002-147902 | A | 5/2002 |
| JP | 2002-213843 | A | 7/2002 |
| JP | 2004-077033 | A | 3/2004 |
| JP | 2004-108715 | A | 4/2004 |
| JP | 2004-263995 | A | 9/2004 |
| JP | 2008-202894 | A | 9/2008 |
| WO | 2011/064813 | A1 | 6/2011 |

OTHER PUBLICATIONS

International Preliminary Report of corresponding PCT Application No. PCT/JP2013/062946 dated Dec. 4, 2014.
International Search Report of corresponding PCT Application No. PCT/JP2013/062946 dated Aug. 13, 2013.

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2012-117802, filed in Japan on May 23, 2012, the entire contents of which are hereby incorporated herein by reference.

TECHNICAL FIELD

The present invention relates to a refrigeration apparatus and particularly a refrigeration apparatus that uses R32 as a refrigerant and is equipped with an accumulator.

BACKGROUND ART

Conventionally, refrigeration apparatus such as air conditioning apparatus have included refrigeration apparatus that use R32 as a refrigerant. An air conditioning apparatus that uses a refrigerant such as R32 is described, for example, in JP-A No. 2004-263995. This air conditioning apparatus is equipped with a hot gas bypass circuit and an automatic opening and closing valve that divert some of hot gas discharged from a compressor and introduce it to an accumulator as a countermeasure in a case where refrigerating machine oil and liquid refrigerant have separated into two layers in the accumulator. Additionally, in accordance with a condition such as the temperature of the hot gas, the automatic opening and closing valve is opened to thereby guide the hot gas to the bottom portion of the accumulator, so that the liquid refrigerant and the refrigerating machine oil that have separated into two layers are agitated and the refrigerating machine oil is returned to the compressor from the accumulator.

SUMMARY

Technical Problem

As described above, the air conditioning apparatus of JP-A No. 2004-263995 is disposed with the hot gas bypass circuit and the automatic opening and closing valve for guiding the hot gas to the bottom portion of the accumulator, but the manufacturing cost of the apparatus rises by that much. Furthermore, unless control of the opening and closing of the automatic opening and closing valve is appropriately performed, a situation arises where agitation is not performed even when the liquid refrigerant and the refrigerating machine oil have separated into two layers inside the accumulator.

It is a problem of the present invention to eliminate, appropriately and at a low cost, the separation of liquid refrigerant and refrigerating machine oil into two layers inside an accumulator in a refrigeration apparatus that uses R32 as a refrigerant and is equipped with the accumulator.

Solution to Problem

A refrigeration apparatus pertaining to a first aspect of the present invention is a refrigeration apparatus that uses R32 as a refrigerant, and is equipped with a compressor, a condenser, an expansion mechanism, an evaporator, and an accumulator. The compressor sucks in the refrigerant from a suction flow path and compresses the refrigerant. The condenser condenses the refrigerant that has been discharged from the compressor. The expansion mechanism expands the refrigerant that has exited the condenser. The evaporator evaporates the refrigerant that has expanded in the expansion mechanism. The accumulator is disposed in the suction flow path and has a casing, an inlet pipe, and an outlet pipe. The casing forms an inside space for separating the refrigerant into gas refrigerant and liquid refrigerant and accumulating surplus refrigerant. The inlet pipe is a pipe for feeding the refrigerant that has evaporated in the evaporator into the inside space of the casing. The outlet pipe is a pipe for channeling the gas refrigerant that has separated in the inside space of the casing to the compressor. Additionally, a distal end opening in the inlet pipe of the accumulator is located in a height position separated by a dimension of 0 to 0.3 times the height dimension of the inside space from a bottom of the inside space of the casing.

Here, the distal end opening in the inlet pipe that feeds the refrigerant flowing from the evaporator into the inside space of the casing is located in a position lower than a height position separated by a dimension of 0.3 times the height dimension of the inside space from the bottom of the inside space of the casing. That is, the distal end opening in the inlet pipe is positioned in the lower part of the inside space of the casing, so even when the liquid refrigerant has accumulated in the inside space of the accumulator, two layer separation has occurred, and the refrigerating machine oil has accumulated in the upper part, the refrigerant introduced through the inlet pipe from the evaporator agitates the liquid refrigerant and refrigerating machine oil that have separated into two layers to thereby eliminate the two layer separation.

The accumulator fulfills the role of accumulating refrigerant that becomes surplus refrigerant because of operating conditions and the role of accumulating refrigerant when the liquid refrigerant has transitionally returned from the evaporator. Furthermore, in the present invention, an agitation effect is obtained by taking into consideration the height position of the distal end opening in the inlet pipe that has conventionally been present and positioning it in the lower part of the inside space of the accumulator to an extent that has not been conventional. For this reason, manufacturing costs are also kept from rising.

A refrigeration apparatus pertaining to a second aspect of the present invention is the refrigeration apparatus pertaining to the first aspect, wherein the distal end opening in the inlet pipe of the accumulator faces a direction along a side surface of the casing.

Here, the distal end of the inlet pipe is positioned in the lower part of the inside space of the casing, but the distal end opening in the inlet pipe is made to face the direction along the side surface of the casing, so excessive foaming is controlled.

A refrigeration apparatus pertaining to a third aspect of the present invention is the refrigeration apparatus pertaining to the first or second aspect, wherein the distal end opening in the inlet pipe of the accumulator faces upward or diagonally upward.

Here, when the liquid refrigerant and the refrigerating machine oil have separated into two layers in the inside space of the accumulator, the vertically separated refrigerating machine oil and liquid refrigerant become efficiently agitated and mixed together because the flow of the refrigerant introduced from the inlet pipe has an upward vector.

A refrigeration apparatus pertaining to a fourth aspect of the present invention is the refrigeration apparatus pertaining to any of the first to third aspects, wherein the casing of the accumulator includes a tubular body whose top and bottom are open, an upper cover that closes off the opening in the top of the tubular body, and a lower cover that closes off the opening in the bottom of the tubular body. Additionally, the height position of the distal end opening in the inlet pipe of the accumulator is lower than the height position of an upper end of the lower cover.

Here, the height position of the distal end of the inlet pipe of the accumulator is lowered as far as a position lower than the upper end of the lower cover. For this reason, the liquid refrigerant and refrigerating machine oil that have separated into two layers can be agitated more reliably.

Advantageous Effects of Invention

According to the refrigeration apparatus pertaining to the first aspect of the present invention, the distal end opening in the inlet pipe of the accumulator is positioned in the lower part of the inside space of the casing, so even when two layer separation has occurred and the refrigerating machine oil has accumulated in the upper part, the refrigerant introduced through the inlet pipe from the evaporator agitates the liquid refrigerant and refrigerating machine oil that have separated into two layers to thereby eliminate the two layer separation.

According to the refrigeration apparatus pertaining to the second aspect of the present invention, the distal end opening in the inlet pipe of the accumulator is made to face the direction along the side surface of the casing, so excessive foaming is controlled.

According to the refrigeration apparatus pertaining to the third aspect of the present invention, the vertically separated refrigerating machine oil and liquid refrigerant become efficiently agitated and mixed together because the flow of the refrigerant introduced from the inlet pipe of the accumulator has an upward vector.

According to the refrigeration apparatus pertaining to the fourth aspect of the present invention, the liquid refrigerant and refrigerating machine oil that have separated into two layers can be agitated more reliably.

BRIEF DESCRIPTION OF DRAWINGS

DESCRIPTION OF EMBODIMENT (1) Overall Configuration of Air Conditioning Apparatus FIG. 1 is a drawing showing a refrigerant pipe system of an air conditioning apparatus 10 that is a refrigeration apparatus pertaining to an embodiment of the present invention. The air conditioning apparatus 10 is a distributed air conditioning apparatus with a refrigerant pipe system and heats and cools rooms in a building by performing a vapor compression refrigeration cycle operation. The air conditioning apparatus 10 is equipped with an outdoor unit 11 serving as a heat source unit, numerous indoor units 12 serving as utilization units, and a liquid refrigerant connection pipe 13 and a gas refrigerant connection pipe 14 serving as refrigerant connection pipes interconnecting the outdoor unit 11 and the indoor units 12. That is, a refrigerant circuit of the air conditioning apparatus 10 shown in FIG. 1 is configured as a result of the outdoor unit 11, the indoor units 12, and the refrigerant connection pipes 13 and 14 being connected. Additionally, refrigerant is sealed inside the refrigerant circuit shown in FIG. 1, and as described later, a refrigeration cycle operation is performed wherein the refrigerant is compressed, cooled and condensed, reduced in pressure, heated and evaporated, and thereafter compressed again. As the refrigerant, R32 is used. R32 is a low-GWP refrigerant whose global warming potential is low, and is a type of HFC refrigerant. Furthermore, as refrigerating machine oil, an ether-based synthetic oil having some compatibility with R32 is used. Because the air conditioning apparatus 10 uses R32 as the refrigerant, although it also depends on the percentage of the oil component, in a low temperature condition (e.g., 0° C. or lower) the solubility of the refrigerating machine oil sealed together with the refrigerant in order to lubricate a compressor 20 tends to become extremely low.

Figure 1:
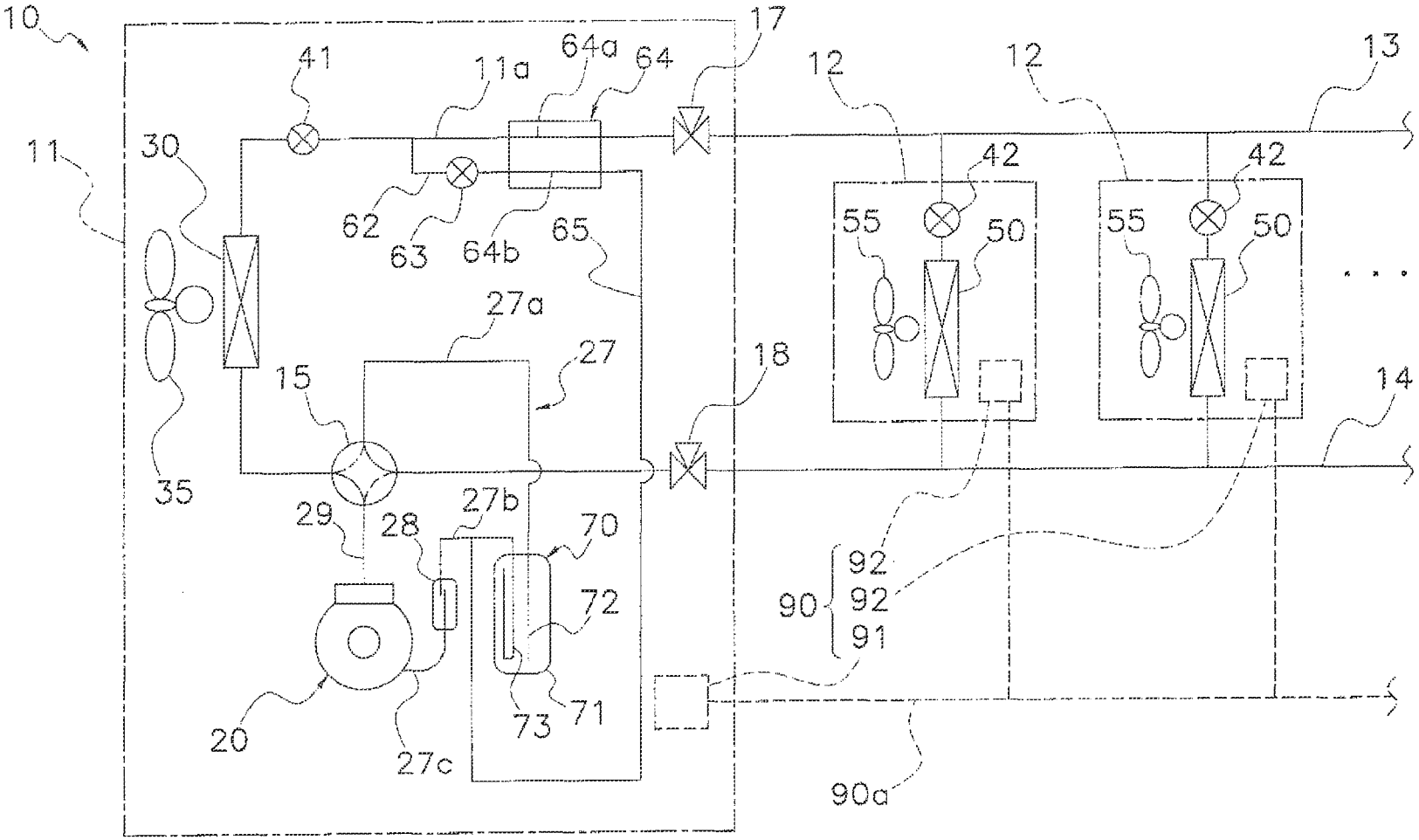
FIG. 1 is a drawing showing a refrigerant pipe system of an air conditioning apparatus pertaining to an embodiment of the present invention.

(2) Detailed Configuration of Air Conditioning Apparatus (2-1) Indoor Units

The indoor units 12 are installed on ceilings or side wails of the rooms and are connected to the outdoor unit 11 via the refrigerant connection pipes 13 and 14. The indoor units 12 mainly have indoor expansion valves 42 that are pressure reducers and indoor heat exchangers 50 serving as utilization-side heat exchangers.

The indoor expansion valves 42 are expansion mechanisms for reducing the pressure of the refrigerant and are electrically powered valves whose opening degree can be adjusted. The indoor expansion valves 42 each have one end connected to the liquid refrigerant connection pipe 13 and the other end connected to the indoor heat exchangers 50.

The indoor heat exchangers 50 are heat exchangers that function as evaporators or condensers of the refrigerant. The indoor heat exchangers 50 each have one end connected to the indoor expansion valves 42 and the other end connected to the gas refrigerant connection pipe 14.

The indoor units 12 are equipped with indoor fans 55 for sucking room air into the units and supplying the air back to the rooms, and cause the room air and the refrigerant flowing through the indoor heat exchangers 50 to exchange heat.

Furthermore, the indoor units 12 each have various sensors and an indoor control unit 92 that controls the actions of each part configuring the indoor units 12. The indoor control units 92 each have a microcomputer and a memory disposed in order to control the indoor units 12, and the indoor control units 92 exchange control signals and so forth with remote controllers (not shown in the drawings) for individually operating the indoor units 12 and exchange control signals and so forth via a transmission line 90*a* with an outdoor control unit 91 of the outdoor unit 11 described later.

(2-2) Outdoor Unit

The outdoor unit 11 is installed outside the building or in the basement of the building in which the rooms equipped with the indoor units 12 exist, and the outdoor unit 11 is connected to the indoor units 12 via the refrigerant connection pipes 13 and 14. The outdoor unit 11 mainly has a compressor 20, a four-way switching valve 15, an outdoor heat exchanger 30, an outdoor expansion valve 41, a supercooling expansion valve 63, a supercooling heat exchanger 64, a liquid-side stop valve 17, a gas-side stop valve 18, and an accumulator 70.

The compressor 20 is a closed compressor driven by a compressor motor. In the present embodiment, there is just one compressor 20, but the compressor 20 is not limited to this and two or more compressors may also be connected in parallel depending, for example, on the number of the indoor units 12 that are connected. The compressor 20 sucks in gas refrigerant via a compressor-attached container 28.

The four-way switching valve 15 is a mechanism for switching the direction of the flow of the refrigerant. During the cooling operation, the four-way switching valve 15 interconnects a refrigerant pipe 29 on the discharge side of the compressor 20 and one end of the outdoor heat exchanger 30 and also interconnects a suction flow path 27 (including the accumulator 70) on the suction side of the compressor 20 and the gas-side stop valve 18 in order to cause the outdoor heat exchanger 30 to function as a condenser of the refrigerant that is compressed by the compressor 20 and cause the indoor heat exchangers 50 to function as evaporators of the refrigerant that has been cooled in the outdoor heat exchanger 30 (see the solid lines of the four-way switching valve 15 in FIG. 1). Furthermore, during the heating operation, the four-way switching valve 15 interconnects the refrigerant pipe 29 on the discharge side of the compressor 20 and the gas-side stop valve 18 and also interconnects the suction flow path 27 and the one end of the outdoor heat exchanger 30 in order to cause the indoor heat exchangers 50 to function as condensers of the refrigerant that is compressed by the compressor 20 and cause the outdoor heat exchanger 30 to function as an evaporator of the refrigerant that has been cooled in the indoor heat exchangers 50 (see the dashed lines of the four-way switching valve 15 in FIG. 1). In the present embodiment, the four-way switching valve 15 is a four-way switching valve connected to the suction flow path 27, the refrigerant pipe 29 on the discharge side of the compressor 20, the outdoor heat exchanger 30, and the gas-side stop valve 18.

The outdoor heat exchanger 30 is a heat exchanger that functions as a condenser or evaporator of the refrigerant. The outdoor heat exchanger 30 has the one end connected to the four-way switching valve 15 and the other end connected to the outdoor expansion valve 41.

The outdoor unit 11 has an outdoor fan 35 for sucking outdoor air into the unit and expelling the air back outdoors. The outdoor fan 35 causes the outdoor air and the refrigerant flowing through the outdoor heat exchanger 30 to exchange heat and is driven to rotate by an outdoor fan motor. The heat source of the outdoor heat exchanger 30 is not limited to outdoor air and may also be another heat medium such as water.

The outdoor expansion valve 41 is an expansion mechanism for reducing the pressure of the refrigerant and is an electrically powered valve whose opening degree can be adjusted. The outdoor expansion valve 41 has one end connected to the outdoor heat exchanger 30 and the other end connected to the supercooling heat exchanger 64. A branching pipe 62 branches from one section of a main refrigerant flow path 11*a* interconnecting the outdoor expansion valve 41 and the supercooling heat exchanger 64. The main refrigerant flow path 11*a* is a main flow path for liquid refrigerant interconnecting the outdoor heat exchanger 30 and the indoor heat exchangers 50.

The supercooling expansion valve 63 is disposed in the branching pipe 62. The supercooling expansion valve 63 is an expansion mechanism for reducing the pressure of the refrigerant and is an electrically powered valve whose opening degree can be adjusted. Furthermore, the branching pipe 62 is connected to a second flow path 64*b* of the supercooling heat exchanger 64. That is, refrigerant that has been diverted from the main refrigerant flow path 11*a* to the branching pipe 62 has its pressure reduced by the supercooling expansion valve 63 and flows to the second flow path 64*b* of the supercooling heat exchanger 64.

The refrigerant that has had its pressure reduced by the supercooling expansion valve 63 and flowed to the second flow path 64*b* of the supercooling heat exchanger 64 exchanges heat with the refrigerant flowing through a first flow path 64*a* of the supercooling heat exchanger 64. The first flow path 64*a* of the supercooling heat exchanger 64 configures part of the main refrigerant flow path 11*a*. The refrigerant that has flowed through the branching pipe 62 and the second flow path 64*b* after exchanging heat in the supercooling heat exchanger 64 is sent by a bypass flow path 65 to a second pipe 27*b* of the suction flow path 27.

The supercooling heat exchanger 64 is an internal heat exchanger employing a dual pipe structure and, as mentioned above, causes the refrigerant flowing through the main refrigerant flow path 11*a* that is the main flow path and the refrigerant that has been diverted from the main refrigerant flow path 11*a* for injection to exchange heat. One end of the first flow path 64*a* of the supercooling heat exchanger 64 is connected to the outdoor expansion valve 41, and the other end is connected to the liquid-side stop valve 17.

The liquid-side stop valve 17 is a valve to which is connected the liquid refrigerant connection pipe 13 for exchanging the refrigerant between the outdoor unit 11 and the indoor units 12. The gas-side stop valve 18 is a valve to which is connected the gas refrigerant connection pipe 14 for exchanging the refrigerant between the outdoor unit 11 and the indoor units 12, and the gas-side stop valve 18 is connected to the four-way switching valve 15. Here, the liquid-side stop valve 17 and the gas-side stop valve 18 are three-way valves equipped with service ports.

Figure 2:
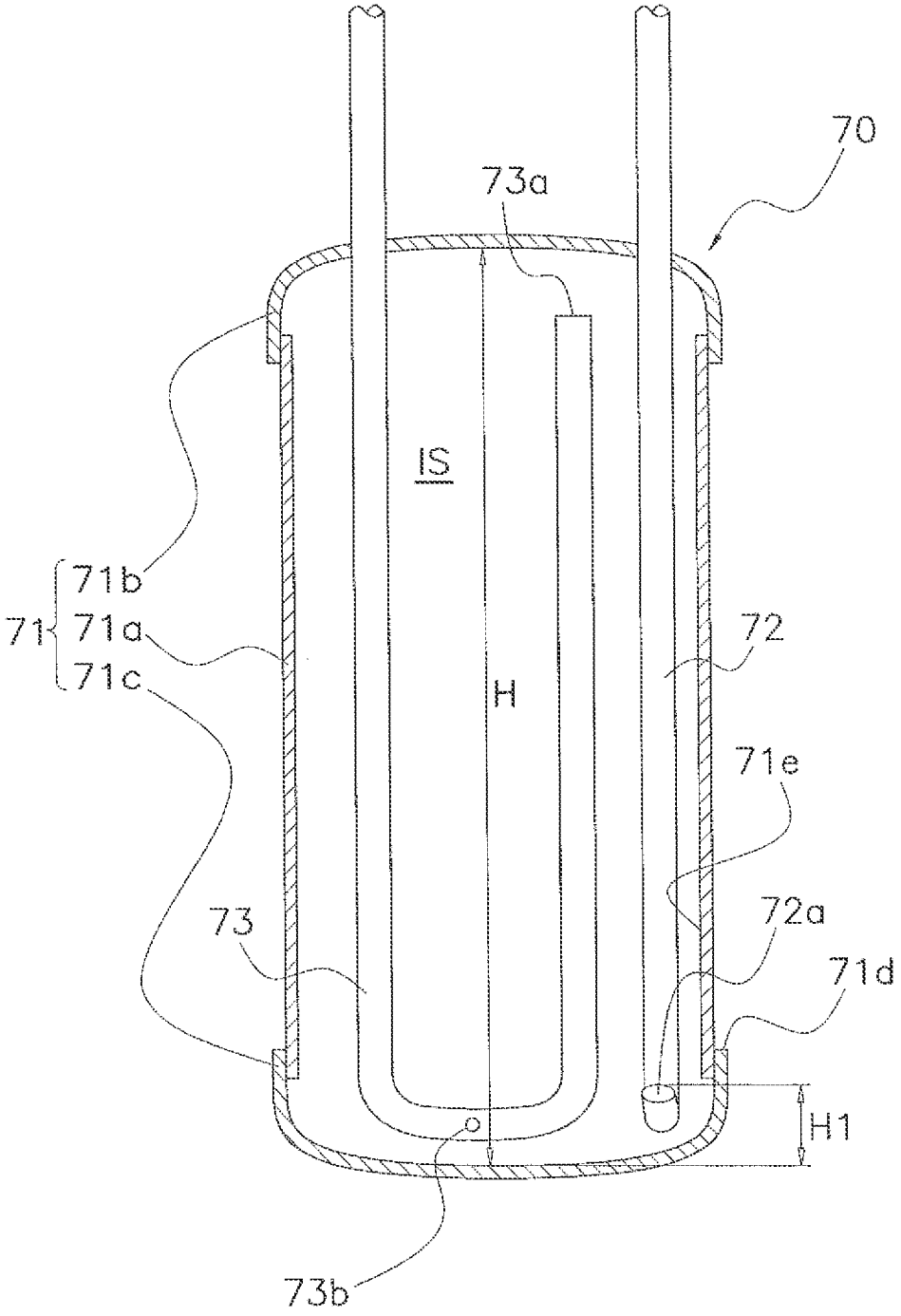
FIG. 2 is a schematic configuration drawing of an accumulator.

The accumulator 70 is disposed in the suction flow path 27 between the four-way switching valve 15 and the compressor 20 and separates, into gas refrigerant and liquid refrigerant, the refrigerant that has returned through a first pipe 27*a* of the suction flow path 27 connected to the four-way switching valve 15 from the indoor heat exchangers 50 or the outdoor heat exchanger 30 functioning as an evaporator. Of the refrigerant that has been separated into gas refrigerant and liquid refrigerant, the gas refrigerant is sent to the compressor 20. As shown in FIG. 1 and FIG. 2, the accumulator 70 has a casing 71 that, forms an inside space IS, an inlet pipe 72, and an outlet pipe 73. The casing 71 is mainly configured from a tubular body 71*a* whose top and bottom are open, a bowl-shaped upper cover 71*b* that closes off the opening in the top of the body 71*a*, and a bowl-shaped lower cover 71*c* that closes off the opening in the bottom of the body 71*a*. The inlet pipe 72 introduces the refrigerant that has traveled through the first pipe 27*a* of the suction flow path 27 into the inside space IS. The inlet pipe 72 penetrates the peripheral edge portion of the upper cover 71*b* and extends toward the bottom of the inside space IS, and the distal end section of the inlet pipe 72 is bent about 150 degrees in the lower portion of the inside space IS. Because of this, a distal end opening 72*a* in the inlet pipe 72 faces diagonally upward. Furthermore, the distal end opening 72*a* in the inlet pipe 72 faces a direction along an inside surface 71*e* of the accumulator 70, so that the refrigerant flowing into the inside space IS from the distal end opening 72*a* becomes a flow that rises upward while traveling around in the circumferential direction along the inside surface 71*e* of the accumulator 70.

The height position of the distal end opening 72*a* in the inlet pipe 72 of the accumulator 70 is located in a position separated by a height dimension H1 from the bottom of the inside space IS of the accumulator 70. The height dimension H1 is 0 to 0.3 times a height dimension H of the inside space IS of the accumulator 70. In what is shown in FIG. 2, the height dimension H1 is equal to or less than ⅕ of the height dimension H. Furthermore, the height position of the distal end opening 72*a* in the inlet pipe 72 of the accumulator 70 is lower than the height position of an upper end 71*d* of the lower cover 71*c* (see FIG. 2).

The outlet pipe 73 of the accumulator 70 sends the gas refrigerant that has separated in the inside space IS to the second pipe 27*b* of the suction flow path 27 connected to the compressor-attached container 28. The outlet pipe 73 is a J-shaped pipe, penetrates the upper cover 71*b*, and makes a U-turn in the lower portion of the inside space IS, and the height position of an outflow opening 73*a* in the upper end (distal end) of the outlet pipe 73 is positioned in the upper portion of the inside space IS. An oil return hole 73*b* is formed in the U-turn section of the outlet pipe 73 in the lower portion of the inside space IS. The oil return hole 73*b* is a hole for returning to the compressor 20 the refrigerating machine oil accumulating together with the liquid refrigerant in the lower portion of the inside space IS of the casing 71.

The outlet pipe 73 of the accumulator 70 and the compressor-attached container 28 are interconnected by the second pipe 27*b* of the suction flow path 27, and the compressor-attached container 28 and the compressor 20 are interconnected by a third pipe 27*c* of the suction flow path 27.

As shown in FIG. 1, the bypass flow path 65 is connected to the second pipe 27*b* of the suction flow path 27. The bypass flow path 65 is a flow path for supplying, to the second pipe 27*b* of the suction flow path 27, the refrigerant that has been diverted from the main refrigerant flow path 11*a* and traveled through the supercooling heat exchanger 64.

Furthermore, the outdoor unit 11 has various sensors and an outdoor control unit 91. The outdoor control unit 91 has a microcomputer and a memory disposed in order to control the outdoor unit 11 and exchanges control signals and so forth via a transmission line 8*a* with the indoor control units 92 of the indoor units 12. A control unit 90 of the air conditioning apparatus 10 is configured by the outdoor control unit 91 and the indoor control units 92.

(2-3) Refrigerant Connection Pipes

The refrigerant connection pipes 13 and 14 are refrigerant pipes installed on site when installing the outdoor unit 11 and the indoor units 12 in an installation location.

(3) Actions of Air Conditioning Apparatus

Next, the actions of the air conditioning apparatus 10 pertaining to the present embodiment will, be described. Control during each operation described below is performed by the control unit 90 functioning as operation control means.

(3-1) Basic Actions during Cooling Operation

During the cooling operation, the four-way switching valve 15 switches to the state indicated by the solid lines in FIG. 1, that is, a state where the gas refrigerant discharged from the compressor 20 flows to the outdoor heat, exchanger 30 and where the suction flow path 27 is connected to the gas-side stop valve 18. The outdoor expansion valve 41 is completely open and the indoor expansion valves 42 have their opening degrees adjusted. The stop valves 17 and 18 are open.

In this state of the refrigerant circuit, the high-pressure gas refrigerant that has been discharged from the compressor 20 is sent through the four-way switching valve 15 to the outdoor heat exchanger 30 functioning as a condenser of the refrigerant, exchanges heat with the outdoor air supplied by the outdoor fan 35, and is cooled. The high-pressure refrigerant that has been cooled and liquefied in the outdoor heat exchanger 30 becomes supercooled in the supercooling heat exchanger 64 and is sent through the liquid refrigerant connection pipe 13 to each of the indoor units 12. The refrigerant that has been sent to each of the indoor units 12 has its pressure reduced by the indoor expansion valves 42, becomes low-pressure refrigerant in a gas-liquid two-phase state, exchanges heat with the room air in the indoor heat exchangers 50 functioning as evaporators of the refrigerant, evaporates, and becomes low-pressure gas refrigerant. Then, the low-pressure gas refrigerant that has been heated in the indoor heat exchangers 50 is sent through the gas refrigerant connection pipe 14 to the outdoor unit 11, travels through the four-way switching valve 15 and the accumulator 70, and is sucked back into the compressor 20. In this way, cooling of the rooms is performed.

In a case where just some indoor units of the indoor units 12 are being operated, the indoor expansion valves 42 of the indoor units that are stopped are set to a stopped opening degree (e.g., completely closed). In this case, virtually no refrigerant passes through the indoor units 12 that are stopped, so that the cooling operation is performed only in the indoor units 12 that are in operation.

(3-2) Basic Actions during Heating Operation

During the heating operation, the four-way switching valve 15 switches to the state indicated by the dashed lines in FIG. 1, that is, a state where the refrigerant pipe 29 on the discharge side of the compressor 20 is connected to the gas-side stop valve 18 and where the suction flow path 27 is connected to the outdoor heat exchanger 30. The outdoor expansion valve 41 and the indoor expansion valves 42 have their openings adjusted. The stop valves 17 and 18 are open.

In this state of the refrigerant circuit, the high-pressure gas refrigerant that has been discharged from the compressor 20 is sent through the four-way switching valve 15 and the gas refrigerant connection pipe 14 to each of the indoor units 12. Then, the high-pressure gas refrigerant that has been sent to each of the indoor units 12 exchanges heat with the room air and is cooled in the indoor heat exchangers 50 functioning as condensers of the refrigerant, thereafter travels through the indoor expansion valves 42, and is sent through the liquid refrigerant connection pipe 13 to the outdoor unit 11. When the refrigerant exchanges heat with the room air and is cooled, the room air is heated. The high-pressure refrigerant that has been sent to the outdoor unit 11 becomes supercooled in the supercooling heat exchanger 64, has its pressure reduced by the outdoor expansion valve 41, becomes low-pressure refrigerant in a gas-liquid two-phase state, and flows into the outdoor heat exchanger 30 functioning as an evaporator of the refrigerant. The low-pressure refrigerant in the gas-liquid two-phase state that has flowed into the outdoor heat exchanger 30 exchanges heat with the outdoor air supplied by the outdoor fan 35, is heated, evaporates, and becomes low-pressure refrigerant. The low-pressure gas refrigerant that has exited the outdoor heat exchanger 30 travels through the four-way switching valve 15 and the accumulator 70 and is sucked back into the compressor 20. In this way, heating of the rooms is performed.

Surplus refrigerant is accumulated in the accumulator 70 particularly during the heating operation.

(3-3) States in Accumulator during Each Operation

Figure 3:
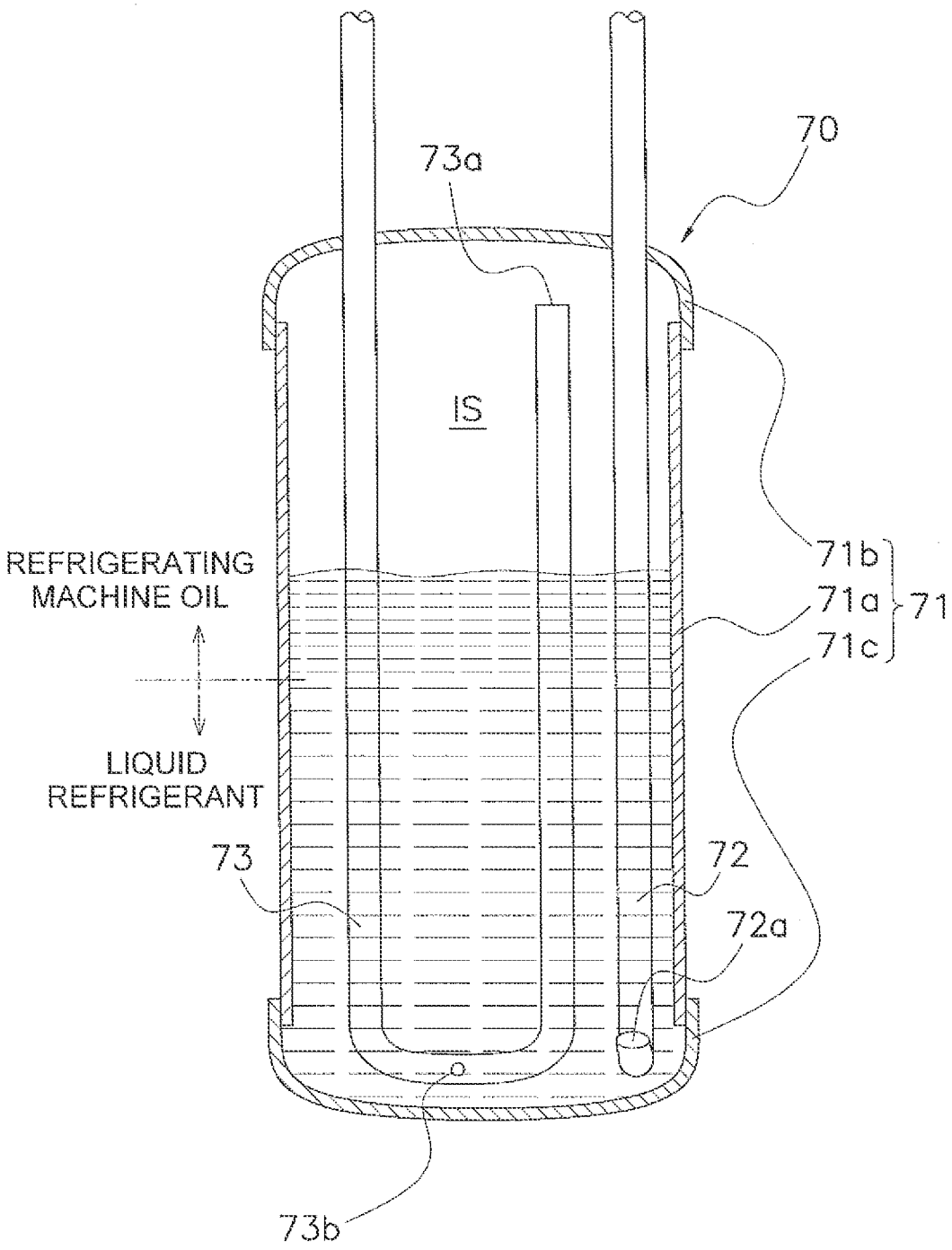
FIG. 3 is a drawing showing the accumulator, with liquid refrigerant and refrigerating machine oil having separated into two layers in an inside space.

As described above, the air conditioning apparatus 10 uses R32 as the refrigerant, so in a low temperature condition (e.g., where the temperature of the refrigerant is 0° C. or lower), the solubility of the refrigerating machine oil sealed together with the refrigerant in order to lubricate the compressor 20 becomes extremely low. For this reason, when the low pressure in the refrigeration cycle is reached, the solubility of the refrigerating machine oil drops greatly because of the drop in the temperature of the refrigerant, so that the R32 that is the refrigerant and the refrigerating machine oil separate into two layers inside the accumulator 70 at which the low pressure is reached in the refrigeration cycle, and it becomes difficult for the refrigerating machine oil to return to the compressor 20. In particular, during the heating operation and at the start of the heating operation when a large amount of surplus refrigerant tends to accumulate, as shown in FIG. 3, there is a tendency for the lower portion of the inside space IS of the casing 71 to be filled with the liquid refrigerant and for the refrigerating machine oil that has separated from the liquid refrigerant to collect in the upper portion of the inside space IS. When this kind of two layer separation occurs, the oil return hole 73*b* in the outlet pipe 73 of the accumulator 70 and the refrigerating machine oil end up being away from one another, so that the refrigerating machine oil accumulating in the inside space IS of the accumulator 70 becomes unable to be returned to the compressor 20.

Figure 4:
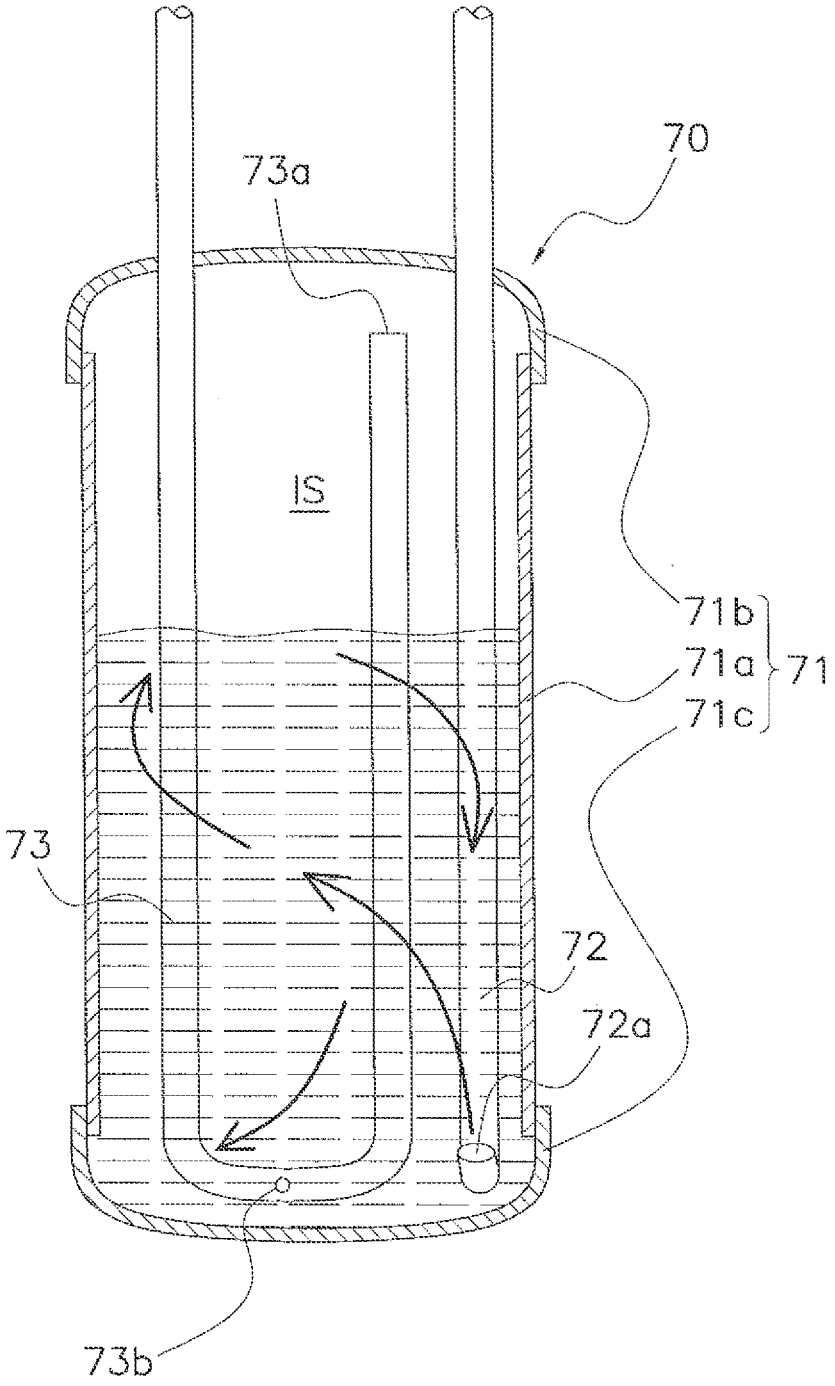
FIG. 4 is a drawing showing the accumulator, with the inside space being agitated by refrigerant from an inlet pipe.

In light of this, in the air conditioning apparatus 10, as described above, the inlet pipe 72 that penetrates the upper cover 71*b* from above to below and is inserted into the inside space IS of the accumulator 70 extends downward as far as the lower portion of the inside space IS. Moreover, the distal end section of the inlet pipe 72 is bent back so that the distal end opening 72*a* in the inlet pipe 72 faces diagonally upward along the inside surface 71*e* of the accumulator 70. Because of this, the low-pressure refrigerant that flows from the evaporator (the outdoor heat exchanger 30 during the heating operation) through the four-way switching valve 15 and the first pipe 27*a* of the suction flow path 27 flows into the accumulator 70 diagonally upward from the distal end opening 72*a* in the inlet pipe 72 positioned in the lower portion of the inside space IS of the accumulator 70. Consequently, as shown in FIG 3, in a case where surplus refrigerant has accumulated in the inside space IS of the accumulator 70 and where the liquid refrigerant whose refrigerant temperature is low and which has accumulated in the inside space IS and the refrigerating machine oil have separated into two layers, the refrigerant flowing into the inside space IS from the inlet pipe 72 fulfills the role of agitating the accumulated refrigerant and refrigerating machine oil. The refrigerant flows into the accumulator 70 diagonally upward from the distal end opening 72*a* in the inlet pipe 72, so as shown in FIG 4, the liquid refrigerant and refrigerating machine oil accumulating in the inside space IS of the accumulator 70 are vertically agitated (see the thick arrows in FIG. 4) so that the two layer separation phenomenon inside the accumulator 70 is eliminated or controlled.

(4) Characteristics of Air Conditioning Apparatus (4-1)

In the air conditioning apparatus 10 pertaining to the present embodiment, the accumulator 70 is designed in such a way that the height position of the distal end opening 72*a* in the inlet pipe 72 that, feeds the low-pressure refrigerant flowing from the evaporator into the inside space IS of the accumulator 70 is lower than a height position separated by a dimension of 0.3 times the height dimension H of the inside space IS from the bottom of the inside space IS. That is, the distal end opening 72*a* in the inlet pipe 72 is positioned in the lower portion of the inside space IS, so even when the liquid refrigerant has accumulated in the inside space IS of the accumulator 70, two layer separation has occurred, and the refrigerating machine oil has accumulated in the upper part, the refrigerant introduced through the inlet pipe 72 from the evaporator agitates the liquid refrigerant and refrigerating machine oil that have separated into two layers to thereby eliminate the two layer separation.

The accumulator 70 fulfills the role of accumulating refrigerant that becomes surplus refrigerant because of operating conditions and the role of accumulating refrigerant when the liquid refrigerant has transitionally returned from the evaporator. Furthermore, in the air conditioning apparatus 10 pertaining to the present embodiment, the aforementioned agitation effect is obtained by taking into consideration the height position of the distal end opening 72*a* in the inlet pipe 72 of the accumulator 70 that has conventionally been present and positioning the distal end opening 72*a* in the lower part of the inside space IS of the accumulator 70 to an extent that has not been conventional. In this way, in the air conditioning apparatus 10, no extra pipes or parts are added, and manufacturing costs are also kept from rising.

(4-2)

In the air conditioning apparatus 10 pertaining to the present embodiment, the distal end section of the inlet pipe 72 of the accumulator 70 is positioned in the lower part of the inside space IS of the casing 71, but the distal end opening 72*a* in the inlet pipe 72 is made to face the direction along the inside surface 71*e* of the casing 71, so excessive foaming is controlled while the agitation effect is obtained.

(4-3)

In the air conditioning apparatus 10 pertaining to the present embodiment, the distal end section of the inlet pipe 72 of the accumulator 70 is bent back in the lower portion of the inside space IS, so that the distal end opening 72*a* in the inlet pipe 72 faces diagonally upward. For this reason, the flow of the refrigerant entering the inside space IS from the inlet pipe 72 has an upward vector, and the refrigerant flows upward while traveling around in the circumferential direction along the inside surface 71*e* from the distal end opening 72*a*. This flow brings about the flow indicated by the heavy lines in FIG. 4 in which the liquid refrigerant and the refrigerating machine oil that accumulate in the inside space IS are vertically mixed together, so that the vertically separated refrigerating machine oil and liquid refrigerant become efficiently agitated and mixed together in the inside space IS.

(4-4)

In the air conditioning apparatus 10 pertaining to the present embodiment, as shown in FIG 2, the height position of the distal end opening 72*a* in the inlet pipe 72 of the accumulator 70 is fixed in a position separated by the height dimension H1 from the bottom of the inside space IS of the accumulator 70, and the height dimension H1 is set to 0 to 30% of the height dimension H of the inside space IS of the accumulator 70. Moreover, the height position of the distal end opening 72*a* in the inlet pipe 72 of the accumulator 70 is made lower than the height position of the upper end 71*d* of the lower cover 71*c*.

For this reason, in the air conditioning apparatus 10, even when the quantities of the liquid refrigerant and refrigerating machine oil accumulating in the inside space IS are small, the liquid refrigerant and the refrigerating machine oil can be agitated.

What is claimed is:

1. A refrigeration apparatus that uses R32 as a refrigerant, the refrigeration apparatus comprising:

a compressor arranged and configured to suck in the refrigerant from a suction flow path and compress the refrigerant;

a condenser arranged and configured to condense the refrigerant that has been discharged from the compressor;

an expansion mechanism arranged and configured to expand the refrigerant that has exited the condenser;

an evaporator arranged and configured to evaporate the refrigerant that has expanded in the expansion mechanism; and an accumulator disposed in the suction flow path, the accumulator having a casing forming an inside space arranged and configured to separate the refrigerant into gas refrigerant and liquid refrigerant and accumulating surplus refrigerant, an inlet pipe arranged and configured to feed the refrigerant that has evaporated in the evaporator into the inside space, and an outlet pipe arranged and configured to channel the separated gas refrigerant to the compressor, a distal end opening in a distal end section of the inlet pipe of the accumulator being located in a height position separated by a dimension from a bottom of the inside space, the dimension being 0 to 0.3 times a height dimension of the inside space the distal end section of the inlet pipe being bent such that the distal end opening in the distal end section of the inlet pipe of the accumulator faces upward or diagonally upward.

2. The refrigeration apparatus according to claim 1, wherein the distal end opening in the distal end section of the inlet pipe of the accumulator faces a direction along a side surface of the casing and faces diagonally upward.

3. The refrigeration apparatus according to claim 2, wherein the casing of the accumulator includes a tubular body having an open top and an open bottom, an upper cover closing off the open top of the tubular body, and a lower cover closing off the open bottom of the tubular body, and the height position of the distal end opening in the distal end section of the inlet pipe of the accumulator is lower than a height position of an upper end of the lower cover.

4. The refrigeration apparatus according to claim 1, wherein the casing of the accumulator includes a tubular body having an open top and an open bottom, an upper cover closing off the open top of the tubular body, and a lower cover closing off the open bottom of the tubular body, and the height position of the distal end opening in the distal end section of the inlet pipe of the accumulator is lower than a height position of an upper end of the lower cover.

* * * * *